US005534986A

United States Patent [19]

Irro et al.

[11] Patent Number: 5,534,986

[45] Date of Patent: Jul. 9, 1996

[54] REPLACEABLE SEPARATING AGENT METERING DEVICE FOR A FUSER ROLLER

[75] Inventors: Otmar Irro, Feldkirchen-Westerham; Helmut Naeser, Munich, both of Germany

[73] Assignee: Siemens Nixdorf Informationssysteme Aktiengesellschaft, Paderborn, Germany

[21] Appl. No.: 428,172

[22] PCT Filed: Oct. 14, 1994

[86] PCT No.: PCT/EP93/02845

§ 371 Date: Apr. 21, 1995

§ 102(e) Date: Apr. 21, 1995

[87] PCT Pub. No.: WO94/09411

PCT Pub. Date: Apr. 28, 1994

[30] Foreign Application Priority Data

Oct. 22, 1992 [DE] Germany ..... 42 35 671.7
Feb. 26, 1993 [DE] Germany ..... 43 06 049.8

[51] Int. Cl.[6] ..... G03G 15/20

[52] U.S. Cl. ..... 355/284; 118/60

[58] Field of Search ..... 355/284, 282, 355/285, 283; 118/60; 219/216; 492/17, 18

[56] References Cited

U.S. PATENT DOCUMENTS

| | | | |
|---|---|---|---|
| 3,731,649 | 5/1973 | Anderson et al. | 118/60 X |
| 3,964,431 | 6/1976 | Namiki | 118/60 |
| 4,908,670 | 3/1990 | Ndebi | 355/284 |
| 5,043,768 | 8/1991 | Baruch | 355/284 |
| 5,045,889 | 9/1991 | Hoover | 355/284 |
| 5,191,380 | 3/1993 | Hoover et al. | 355/284 |
| 5,235,394 | 8/1993 | Mills, III et al. | 355/284 |
| 5,267,004 | 11/1993 | Mills | 355/284 |

FOREIGN PATENT DOCUMENTS

| | | | |
|---|---|---|---|
| 4113112 | 4/1991 | Germany . | |
| 60-172063 | 9/1985 | Japan | 355/284 |
| 02154288 | 6/1990 | Japan | 355/284 |
| 04001689 | 1/1992 | Japan | 355/284 |

OTHER PUBLICATIONS

*Xerox Disclosure Journal,* vol. 10, No. 4, "Rotating Wick", D. J. Lawson et al., Jul./Aug. 1985, pp. 217–218.

*Patent Abstracts of Japan,* vol. 12, No. 2, "Fixing Device", Hiroshi Yokoyama, Jan. 7, 1988, 62–164076.

*Patent Abstracts of Japan,* vol. 13, No. 64, "Offset Preventive Roller for Electrophotographic Fixing Device", 14 Feb. 1989, 63–250673.

*Primary Examiner*—Robert Beatty
*Attorney, Agent, or Firm*—Hill, Steadman & Simpson

[57] ABSTRACT

A separating agent metering device (30) contains a separating agent feed roller (1) which rolls tangentially against the fuser roller (8). In doing so, separating agent from the inside of the separating agent feed roller (1) which has passed to the surface is transferred to the fuser roller (8). The separating agent feed roller (1) contains a carrier tube (6), which is rotatably mounted on a separating agent metering tube (5), and an applicator roller (7) which is arranged on said carrier tube so as to be exchangeable. The applicator roller (7), which contains an applicator sleeve (4) with a layer of material (13) which is permeable to the separating agent attached thereto, can be slid axially over the carrier tube (6).

17 Claims, 5 Drawing Sheets

REPLACEABLE SEPARATING AGENT METERING DEVICE FOR A FUSER ROLLER

BACKGROUND OF THE INVENTION

The invention relates:to a separating agent metering device for supplying separating agent to the surface of a fuser roller of a printer or copier operating by a transfer-printing method.

A separating agent metering device of the conventional type is disclosed in U.S. Pat. No. 3,964,431. Such a separating agent metering device contains a separating agent feed roller which rolls tangentially against the fuser roller and, during this process, applies liquid separating agent to the surface of the fuser roller.

It has been shown that particularly the separating agent feed roller of a heat-and-pressure fusing device undergoes severe abrasion during operation and therefore has to be exchanged regularly. This frequent exchange is greatly disadvantageous especially since a heat-and-pressure fusing device has an operating temperature of about 200° C. This causes, on the one hand, the high degree of wear and, on the other hand, a long waiting time until the parts to be exchanged have cooled down to the extent that they can be changed. The exchange of the parts is frequently so complicated and time-consuming that additionally a specially trained service engineer has to be called to carry out this work. Experience has further shown that additional costs occur due to the fact that parts to be exchanged are misplaced or damaged by being dropped.

Separating agent feed rollers are usually exchanged completely when their surface has become soiled or damaged. In doing so, valuable parts which are not yet worn, for example heat-resistant bearings which are a constituent part of the separating agent feed roller, are generally also disposed of. The new part to be used is therefore comparatively expensive. The present invention is therefore based on the object of designing the separating agent metering device for supplying separating agent to the surface of a fuser roller of a printer or copier operating by the transfer-printing method in such a way that parts subject to wear can be exchanged in a simple manner, have a long service life, are functionally reliable and cost-effective.

SUMMARY OF THE INVENTION

According to the invention, this object is achieved by providing a separating agent metering device for supplying a separating agent to a surface of a fuser roller of a transfer-printing apparatus. The metering device includes a separating agent metering tube with at least one separating agent metering opening arranged on its longitudinal extent. A carrier tube is rotatably mounted on the separating agent metering tube with a plurality of circumferentially positioned passage openings for the separating agent to pass through. A replaceable applicator roller, which is exchangeable after suffering wear, is axially slidable over the carrier tube. The applicator roller has an applicator sleeve which receives the carrier tube and a plurality of passage openings for allowing flow of the separating agent therethrough. The passage openings are at least partially congruent with the passage openings in the carrier tube. A layer of material which is permeable by the separating agent is attached to the outer circumference of the applicator sleeve to apply the separating agent to the fuser roller.

An advantage of the present invention is that, during servicing, the entire separating agent feed roller including the bearing and carrier tube does not have to be exchanged, but only the applicator roller which can be slid axially over the carrier tube and the wear of which is particularly great due to the direct contact with the fuser roller.

According to the invention, the carrier tube is rotatably mounted on a separating agent metering tube with axially arranged separating agent metering openings. Provided in the carrier tube and in an applicator sleeve of the applicator roller are passage openings for the separating agent in the carrier tube and passage openings for the separating agent in the applicator sleeve, which passage openings are at least partially congruent with one another. The separating agent is distributed evenly over the entire length of the separating agent feed roller by means of the separating agent metering opening arranged in the separating agent metering tube. The mutually overlapping passage openings for the separating agent in the carrier tube and in the applicator sleeve guarantee a reliable emergence of the separating agent from the inside of the separating agent feed roller to the outside.

According to a further development and design of the invention, the applicator sleeve is formed from semi-shells which can be plugged together. By this means, the applicator sleeve can be produced cost-effectively. The multi-part design of the applicator sleeve is particularly advantageous if the applicator sleeve is not made of metal, but of a heat-resistant thermoplastic, as in accordance with a further design of the invention. In a corresponding design of the semi-shells, the injection mold of the thermoplastic is identical for both semi-shells.

The applicator sleeve comprising the two joined-together semi-shells can be wrapped in a simple manner in a material which is permeable to the separating agent. As a result, the exchangeable applicator roller can be produced in a simple and cost-effective manner. A paper layer of bonded felt or a vulcanized silicon foam material, which is sheathed by an approximately 0.4 mm thick membrane layer made by Messrs. Gore, is suitable, for example, as a layer of material which is permeable to the separating agent. The latter layer of material which is permeable to the separating agent has the advantage of less soiling compared to felt, easier cleaning of toner residues and paper dust and a longer service life.

In accordance with a further development and design of the invention, positive-locking carrier means are provided between the carrier tube and the applicator roller. These carrier means guarantee the partial congruence of the passage openings for the separating agent in the carrier tube and in the applicator sleeve. This can be effected, for example, by a peripheral toothing on the inner surface of the applicator roller and the outer surface of the carrier tube, which toothings mesh with one another. A further possibility is the positive-locking connection of the carrier tube and the applicator roller by means of a bayonet. In this case, a connecting link is provided in the carrier tube or in the applicator sleeve, into which connecting link a button on the applicator sleeve or the carrier tube enters axially when the applicator roller is slid onto the carrier tube and, when reaching the axial end position, the carrier tube and the applicator sleeve are rotated about their axis relative to one another and, in doing so, the button enters into the radially extending part of the L-shaped connecting link.

In accordance with a further development and design of the invention, at least one radially extending notch is provided both on the outside diameter of the carrier tube and on the inside diameter of the applicator roller in each case in the region of the end faces. With the aid of these notches, liquid separating agent is prevented from emerging at the end faces of the separating agent feed roller due to its two-part design.

In accordance with a further development and design of the invention, the separating agent metering device can be pivoted by means of a pivoting apparatus about an axis of rotation parallel to the axis of the fuser roller into positions assigned to different operating positions. As a result, the separating agent metering device can be pivoted away from the fuser roller in a simple, user-friendly and captive manner. A first pivoted position is the rest position of the separating agent metering device which the latter always assumes when the fusing operation of the heat-and-pressure fusing device has been interrupted. Unnecessary heating-up of the separating agent feed roller is thus avoided, thus increasing the service life of the separating agent feed roller.

A further pivoted position is a servicing position of the separating agent metering device. In accordance with a further development of the design of the invention, the separating agent feed roller can be removed from the separating agent metering device in this servicing position. In this case, the exchange is so easy that an operator who has not been trained specifically can carry out the exchange of the separating agent feed roller.

A further advantage of the pivotability of the separating agent metering device is that no adjustment work is necessary after the separating agent feed roller has been exchanged. The separating agent metering device lies freely on the fuser roller under its own weight, guided by its pivoting axis, as a result of which the contact width (the so-called nip) between the fuser roller and the separating agent feed roller is constant in the axial direction.

A further design and development of the invention, according to which a separating agent inlet plug protrudes radially from the separating agent metering tube and a separating agent inlet bush is arranged on the separating agent metering device in such a way that the separating agent inlet plug enters into the separating agent inlet bush when the separating agent feed roller is inserted into the oil metering device, brings about a further simplification of the exchange of the applicator roller. The separating agent feed roller can be separated completely from the separating agent metering device by means of a single operation, and the applicator roller can be exchanged without the carrier tube and the separating agent metering tube being connected to the separating agent metering device.

In accordance with a further design and further development of the invention, the ends of the separating agent metering tube are mounted in a first and a second flange. The first flange has a fitting bore whose axis is flush with the axis of the separating agent metering tube when it is in the installation position, and whose end-face base has at least one flange passage connected to a separating agent supply device. The end of the separating agent metering tube mounted in the first flange is designed as a clutch disk whose outer surface has the shape of a spherical segment with a radius equal to the radius of the fitting bore, and whose axis of symmetry disposed perpendicular to the flat part of the surface of the spherical segment is flush with the axis of the separating agent metering tube. The clutch disk has a passage which is directed axially, leads to the separating agent metering tube and is flush with the axially aligned part of the flange passage. This design and further development allows simple changing of the separating agent feed roller so that personnel who have not been specially trained can carry out the exchange in a particularly simple manner, even at a high temperature of the separating agent feed roller. A high degree of servicing efficiency is thus achieved. The construction of the clutch device guarantees absolute tightness of the clutch during operation. The outer shape of the clutch disk which corresponds to a spherical segment guarantees that the clutch disk can be introduced into the fitting bore without jamming.

In accordance with a further design and further development of the invention, a sealing disk can be placed between the clutch disk and the base of the fitting bore, which sealing disk has a passage which is flush with the axially aligned part of the flange passage.

The tightness of the clutch during operation and the reliability of the hydraulic clutch are thus increased further.

In accordance with a further design and further development of the invention, the second flange is designed as a movable bearing, in which the separating agent metering tube can be placed in the radial direction. Provided on the movable bearing are at least one locking element, which secures the separating agent metering tube against dropping out radially, and at least one element which presses the separating agent metering tube axially in the direction of the first flange. The installation position of the separating agent feed roller in the separating agent metering device cannot be confused due to the different shape of the ends of the separating agent metering tube mounted in the flanges.

Owing to the locking means in interaction with the power means in the region of the second flange, a simple means is shown with which the separating agent feed roller can be held securely in the separating agent metering device. Additionally, the power of the power means serves to achieve the tightness of the clutch device. A flap which closes the movable bearing in an annular manner can serve as locking means. The flap can be locked by means of a snap-on mechanism in its position which secures the separating agent metering tube against dropping out. Suitable as power means are all types of springs whose power can be conducted in the desired axial direction. A weight can also act as a power source, whose power can be conducted in the desired axial direction, for example by means of a wire cable.

In accordance with a further development and design of the invention, a leaf spring is attached on one side of the second flange, which leaf spring engages in a positive-locking manner around the corresponding end of the separating agent metering tube to lock it against dropping out and presses the separating agent metering tube axially in the direction of the first flange. If the power required cannot be raised with a single leaf spring, a plurality of leaf springs, arranged one above the other, can raise this power. Such an arrangement is called a leaf-spring assembly. The leaf-spring assembly, which at the same time holds the separating agent feed roller non-positively in the radial direction, guarantees a particularly simple change of the separating agent feed roller. The separating agent feed roller can be removed from the separating agent metering device by lifting it out jerkily on one side counter to the friction force of the leaf-spring assembly. In the reverse direction, too, when installing the separating agent feed roller, after introducing the clutch disk into the fitting bore only a jerk counter to the friction force of the leaf-spring assembly has to be carried out. The separating agent metering tube engages in the leaf spring in a positive-locking manner, which is the end of the installation measure.

In accordance with a further development and design of the invention, a peripheral fitting-bore groove is provided in the base of the fitting bore along its axially directed walls so that the base has a ram-like elevation, into whose surface the flange passage opens out. On the opposite side, the clutch disk has an axially directed depression in which the sealing means can be placed. In this case, the cross section of the ram-like elevation is smaller than the cross section of the depression in the clutch disk. The sealing disk is particularly well protected from damaging mechanical influences in the depression in the clutch disk. The ram-like elevation enters into the depression of the clutch disk and presses the sealing means into the depression due to the axial force starting from the second flange.

In accordance with a further development and design of the invention, the sealing means is held in the depression in a positive-locking manner by a collar which reduces the cross section of the depression. The sealing disk is thus connected captively to the clutch disk.

In accordance with a further development and design of the invention, spring rings are provided, which can be slid over the separating agent metering tube and with the aid of which individual metering tube openings can be closed. By means of these spring rings, the width of the separating agent application on the fuser roller can be adapted to the actual width of the recording media processed by the heat-and-pressure fusing device. Therefore no excess separating agent passes onto the fuser roller, as a result of which the latter becomes less soiled and the functional reliability is thus increased.

Additional features and advantages of the present invention are described in, and will be apparent from, the detailed description of the presently preferred embodiments and from the drawings.

BRIEF DESCRIPTION OF THE DRAWINGS

Examples of the invention are described in greater detail below with reference to the drawing, in which.

DETAILED DESCRIPTION OF THE PRESENTLY PREFERRED EMBODIMENTS

Figure 1:
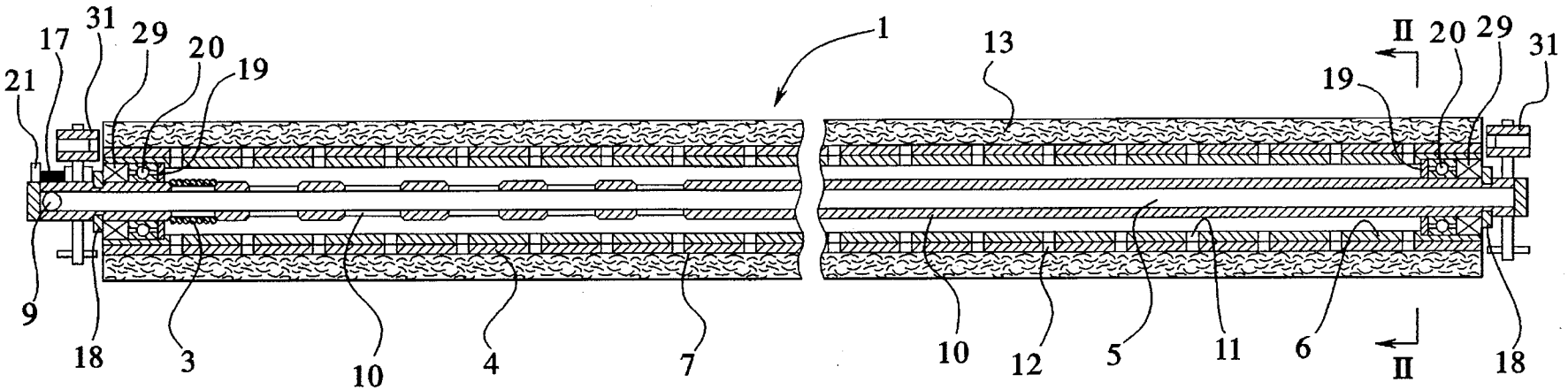
FIG. 1 shows a separating agent feed roller in axial section.
Figure 4:
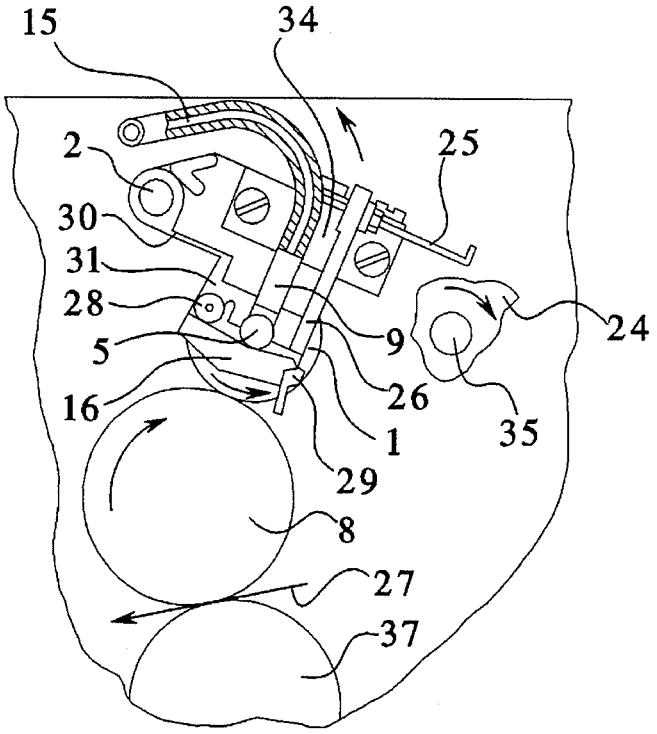
FIG. 4 shows a first embodiment of a heat-and-pressure fusing device in a lateral view with a separating agent metering device and separating agent inlet plug in the operating position.
Figure 5:
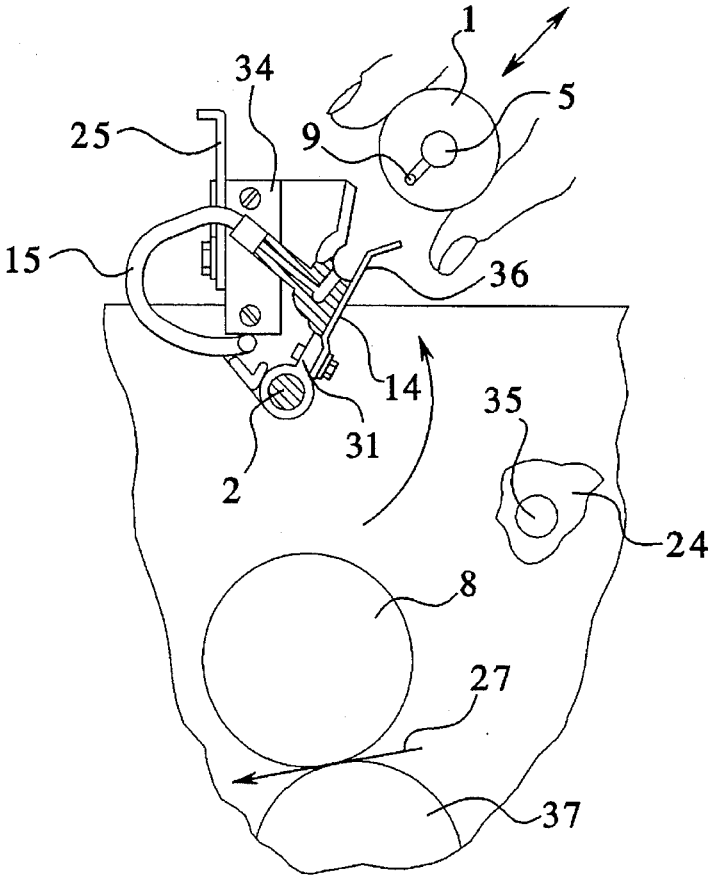
FIG. 5 shows a further embodiment of a heat-and-pressure fusing device in a lateral view with a separating agent metering device and separating agent inlet bushing in the servicing position.

FIGS. 1, 4 and 5 shows a separating agent feed roller 1 which is an essential constituent part of a separating agent metering device 30. With the aid of the separating agent feed roller 1, liquid separating agent is applied to a fuser roller 8. The separating agent prevents particles of toner being deposited on the surface of the fuser roller 8 and thus assists the fusing operation in a heat-and-pressure fusing device. Oil is generally used as separating agent, but any other desired liquid can be used which fulfills the intended task.

Referring to FIG. 1, the separating agent feed roller contains a carrier tube 6 with an applicator roller 7 arranged thereon so as to be exchangeable. The applicator roller 7 can be slid axially over the carrier tube 6. At the end of the sliding-on operation, carrier means of the carrier tube 6 and of the applicator roller 7 mesh with one another in a positive-locking manner. The position of the applicator roller 7 relative to the carrier tube 6 is thus fixed.

The position thus fixed guarantees that a plurality of passage openings 11 for the separating agent in the carrier tube 6 and in an applicator sleeve 4 are congruent. The applicator sleeve 4 has a plurality of passage openings 12. The applicator sleeve 4 is a constituent part of the applicator roller 7. Separating agent from the inside of the carrier tube 6 can pass through the passage openings 11, 12 for the separating agent in the carrier tube 6 and in the applicator sleeve 4 into a layer of material 13 on the applicator sleeve 4, which material is permeable to the separating agent. The layer of material 13 which is permeable to the separating agent is a constituent part of the applicator roller 7. The separating agent diffuses through the layer of material 13 which is permeable to the separating agent to the surface of the separating agent feed roller 1. From there, the separating agent is transferred directly onto the fuser roller 8 by rolling tangentially thereto. An even provision of the separating agent to the layer of material 13 which is permeable to the separating agent is guaranteed by four rows of passage openings 11, 12, arranged at equal intervals relative to one another, in the carrier tube 6 and in the applicator sleeve 4 respectively.

The separating agent passes into the inside of the carrier tube 6 with the aid of a separating agent metering tube 5. The separating agent metering tube 5 serves additionally as an axis of rotation of the separating agent feed roller i and consequently passes axially through the carrier tube 6. In the region of its end faces, the carrier tube 6 is rotatably mounted on the separating agent metering tube 5 by means of heat-resistant deep groove ball bearings 20. Provided on the sides of the deep groove ball bearings 20 facing towards the inner side of the roller are shaft seals 19 which prevent any emergence of separating agent through the deep groove ball bearings 20. Retaining washers 18 are provided on the outer sides of the deep groove ball bearings 20 to prevent axial movements of the carrier tube 6 on the separating agent metering tube 5, due regard-being given to sufficient clearance to compensate for the thermal expansion differences between the separating agent metering tube 5 and the carrier tube 6.

Separating agent is pumped into the separating agent metering tube 5 from a supply container (not illustrated) by a hose 15 plugged onto a separating agent inlet plug 9. Separating agent metering openings 10 are arranged axially in the separating agent metering tube 5. The separating agent emerges from these separating agent metering openings 10 and passes via the passage openings 11, 12 for the separating agent in the carrier tube 6 and in the applicator sleeve 4 into the layer of material 13 which is permeable to the separating agent.

The diameter of the separating agent metering tube 5 is reduced in each case in the region of some adjacent separating agent metering openings 10 in such a way that a spring ring 3 can be slid in each case onto the separating agent metering tube 5 to cover a corresponding separating agent metering opening 10, secured axially against displacement. Each spring ring 3 partially surrounds the separating agent metering tube 5. By turning the spring ring 3 on the separating agent metering tube 5, the assigned separating agent metering opening 10 can be closed or opened by hand. Adaptation of the width of the separating agent application on the fuser roller 8 to the width of a recording medium 27 (FIGS. 4–6) is thus possible.

In order to prevent separating agent from passing between the applicator sleeve 4 and the carrier tube 6 via the end faces of the separating agent feed roller 1 to the outside, two paired peripheral notches 29 are provided in each case in the region of each end face both on the outside diameter of the carrier tube 6 and on the inside diameter of the applicator sleeve 4. The notches 29 on the applicator sleeve side additionally have bores to the outside diameter of the applicator sleeve 4. The notches 29 serve as a labyrinth for the separating agent and prevent the residue of separating agent which has not been soaked up by the layer of material 13 which is permeable to the separating agent from emerging at the end faces of the separating agent feed roller 1. In contrast, the residue of separating agent is given off into the layer of material 13 which is permeable to the separating agent via the bores in the notches 29.

Figure 2:
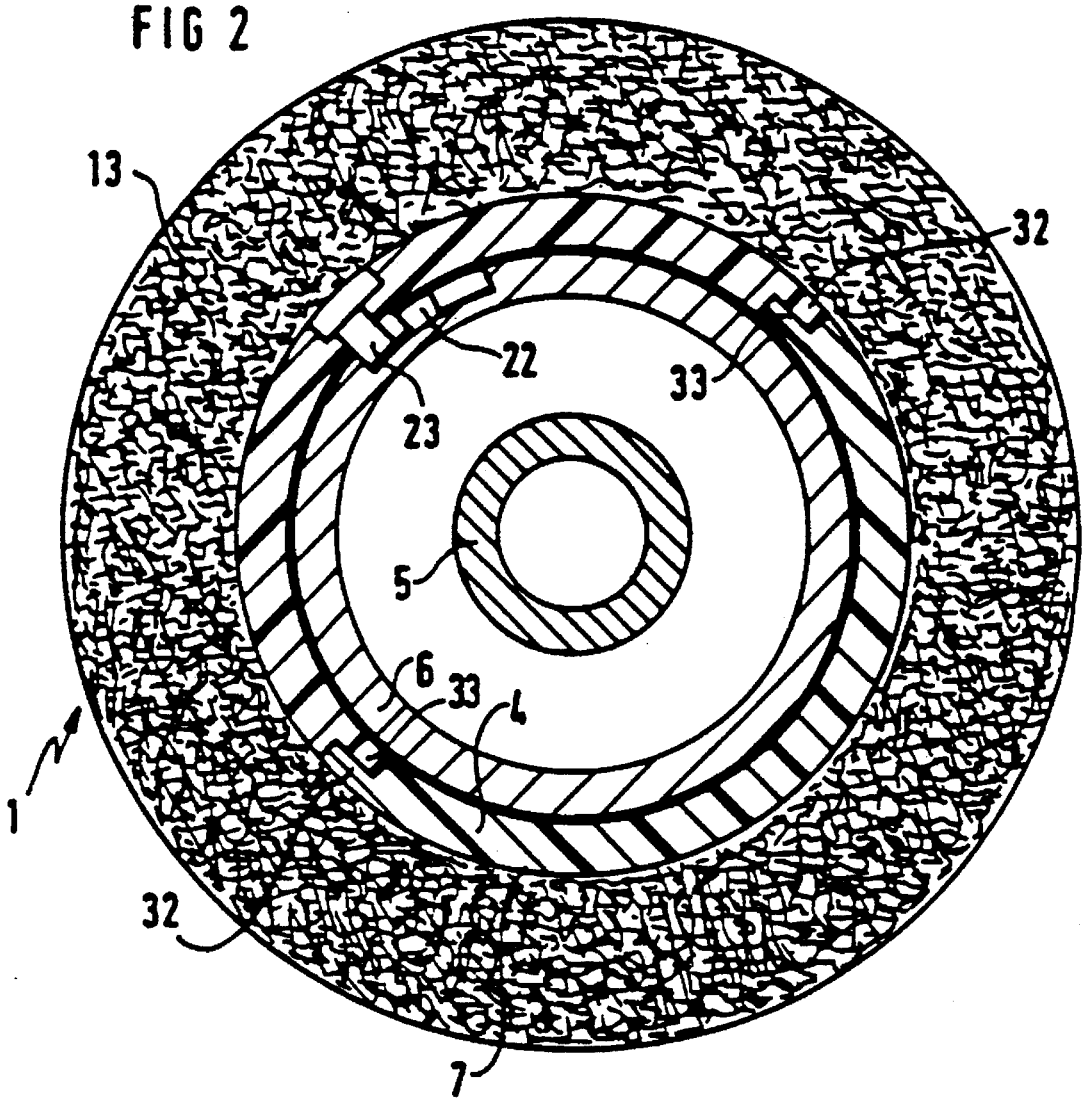
FIG. 2 shows a separating agent feed roller in radial section.
Figure 3:
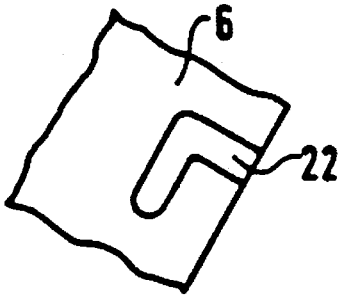
FIG. 3 shows a connecting link in the carrier tube.

Provided as a positive-locking carrier means between the applicator roller 7 and the carrier tube 6 is a bayonet closure comprising a connecting channel or link 22 and a button 23 (see FIGS. 2 and 3). The connecting link 22 is L-shaped, one limb being introduced in the axial direction and one limb being introduced in the radial direction into the surface of the carrier tube. The button 23 projects out of the inside diameter of the applicator sleeve 4. When the applicator roller 7 is slid axially onto the carrier tube 6, the button 23 passes into the axial limb of the connecting link 22. When the axial end position of the applicator roller 7 has been reached, the radial limb of the connecting link 22 begins. It can now been seen in FIG. 1 that an axially movable pin 21 to fix the carrier tube 6 securely against rotation is provided in one of the two flanges 31 to which the separating agent feed roller 1 is attached at the end faces. The pin 21 is pressed away from the separating agent feed roller 1 by a compression spring 17. If the bayonet closure is to be locked, the pin 21 is pressed into a notch in the carrier tube 6 so that the carrier tube 6 can no longer be rotated. The applicator roller 7 is then moved radially so that the button 23 enters into the radial limb of the connecting channel or link 22 as far as the stop. The carrier tube 6 and the applicator roller 7 are thus assigned to one another axially and are moved radially together due to the bayonet closure.

The applicator sleeve 4 comprises two thermoplastic semi-shells. In contrast to the variant in which the applicator sleeve 4 is composed of a machined aluminum tube with passage openings 12 for the separating agent bored axially in four rows (e.g. 80 holes), an applicator roller 7 with an applicator sleeve 4 produced as thermoplastic semi-shells is more cost-effective. This is due mainly to the fact that the passage openings 12 for the separating agent are made in the semi-shells during the injection-molding operation of the thermoplastic semi-shells practically at no cost. The boring of the passage openings 12 for the separating agent is dispensed with. An injection-moldable material Rython R-4 which is heat-resistant up to 180° C. is suitable as a thermoplastic. This material is also suitable because its thermal expansion coefficient matches the thermal expansion coefficient of the carrier tube 6 produced from aluminum.

As illustrated in FIG. 2 the two identical semi-shells of the applicator sleeve 4 are joined together radially to form a tube by means of inner centering ribs 33 and outer centering ribs 32 which mesh with one another in a positive-locking manner. The layer of material 13 which is permeable to the separating agent is wrapped spirally around said tube and ensures that the semi-shells remain fitted together.

In a particularly cost-effective manner, differing from the present example, the connecting link 22 can be provided in the semi-shells of the applicator sleeve 4 on the inside diameter thereof. The connecting link 22 can be produced in a particularly simple manner by the injection-molding process. The button 23 then only has to be provided on the carrier tube 6.

Figure 6:
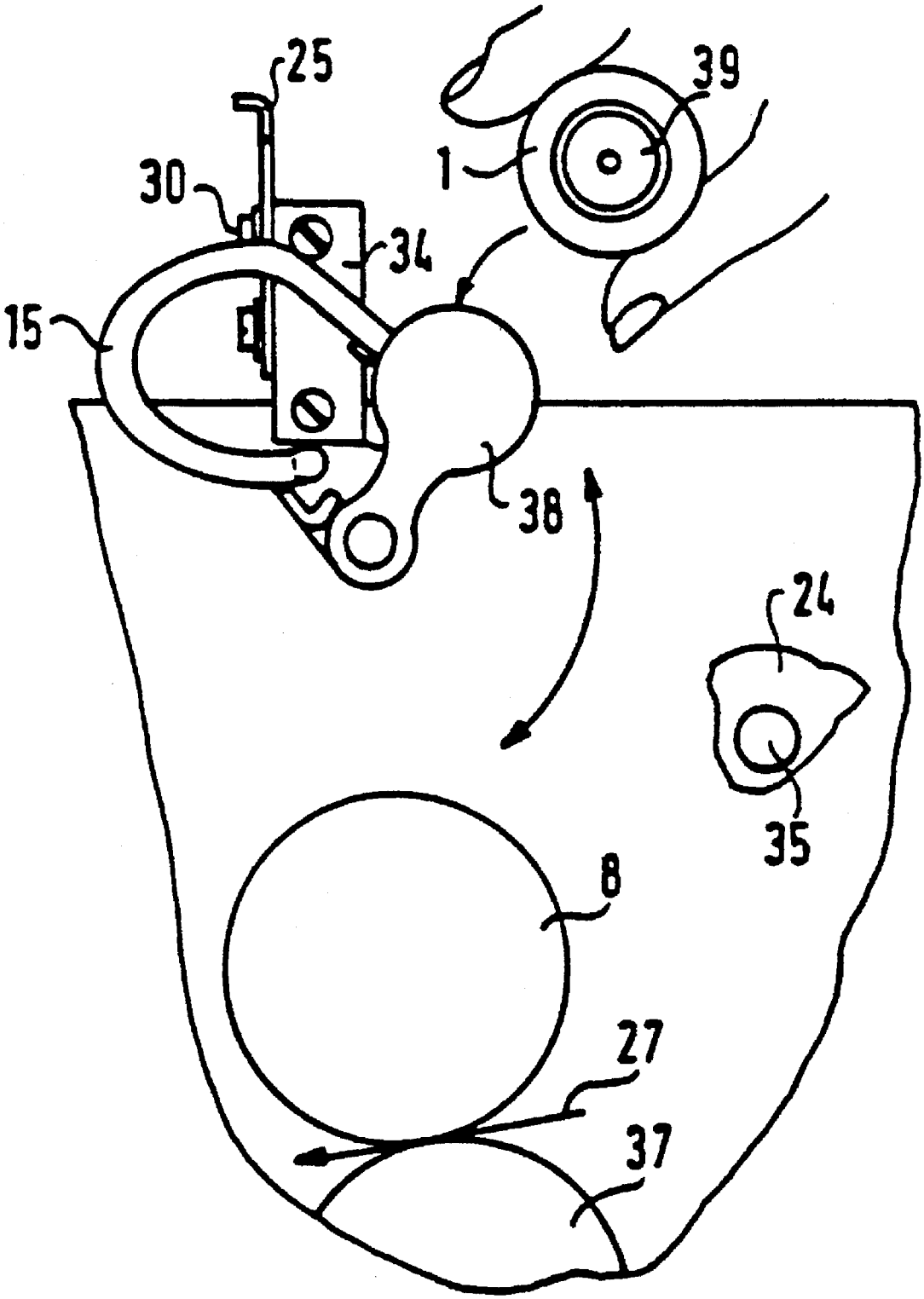
FIG. 6 shows a further embodiment of a heat-and-pressure fusing device in a lateral view with a separating agent metering device and clutch disk in the servicing position.

FIGS. 4, 5 and 6 show the arrangement of the separating agent metering device 30 in the heat-and-pressure fusing device. A recording medium 27 is fed to the heat-and-pressure fusing device of a printer or copier operating by the transfer-printing method. In this case, the recording medium 27 passes between a nipping roller 37 and the fuser roller 8. The fuser roller 8 and the nipping roller 37 roll against one another and convey the recording medium 27 further by friction.

In FIGS. 4, 5 and 6, three different design variants of the separating agent metering device 30 are shown. In all the variants, the separating agent metering device 30 is mounted so as to be pivotable about an axis of rotation 2 parallel to the axis of the fuser roller. A flat steel, e.g. 40 mm×15 mm or an aluminum extruded profile forms the basic body of the separating agent metering device 30. Compared to the aluminum, the flat steel has the advantage that it has an intended greater dead weight. The flat steel extends in parallel along the fuser roller 8. Provided at the end faces of the flat steel are flanges 31, 38, 50 which serve to attach the separating agent metering tube 5 and thus the separating agent feed roller 1. Using an aluminum extruded profile, a weight 34 is provided on the side of the profile facing away from the fuser roller 8, the weight being so great that the nipping force of the separating agent feed roller 1 on the fuser roller 8 is so great that a reliable and sufficient application of separating agent can take place. The weight 34 also ensures that the separating agent feed roller I can be driven constantly by friction by the fuser roller 8. When flat steel is used, the weight 34 is not required. With a dead weight of about 1.4 kg of the flat steel, the effect is nevertheless achieved.

Additionally, the design variants have in common the fact that a sheet-metal angle 25 projects from the separating agent metering device 30 on the side of the latter opposite the axis of rotation 2 at a right angle to said axis of rotation 2. When the separating agent metering device 30 is in the operating position (see FIG. 4), an actuating cam 24 is located vertically below the angle 25. In the operating position of the separating agent metering device 30, the cam 24 does not touch the angle 25. In the case of a pause in the fusing operation, the cam 24 is turned by a shaft 35 and consequently presses the angle 25 upwards in the vertical direction. As a result, the separating agent metering device 30 is pivoted away from the fuser roller 8 at least to the extent that the separating agent feed roller 1 and the fuser roller 8 no longer contact one another. In a pause in the fusing operation, a nipping roller 37 is also pivoted away from the fuser roller 8 by means which are not described in greater detail here.

The design variants in accordance with FIGS. 4, 5 and 6, differ in the type of attachment of the separating agent feed roller i in the separating agent metering device 30. Provided in the flanges 31, in accordance with FIG. 4, are two semi-shells in which the separating agent metering tube 5 can be placed. In order to secure the separating agent metering tube 5 axially and radially against displacement, a pin (not illustrated) is provided on the separating agent metering tube 5, which pin enters into a corresponding bore in one of the semi-shells. Two locking bars 16 assigned to the semi-shells hold the separating agent metering tube 5 in the semi-shells. The locking bars 16 are connected to the flanges 31 so as to be pivotable on one side via a locking-bar pivot 28. At the end of the locking bars located opposite the locking-bar pivot 28, the locking bars are designed in the manner of hooks. In the pivoting direction, the hooks have a run-up slope which, during the pivoting operation, deflects a leaf spring 26, assigned to the locking bar 16 in each case, away from the end of the locking bar until the pivoting operation has been completed and the locking bar holds the separating agent metering tube 5 in its intended position in the semi-shells. At the end of this pivoting operation, the hook enters into an opening provided in the leaf springs 26, as a result of which the leaf spring 26 springs back into the locking bar 16 and holds the latter in its intended position.

The removal of the separating agent feed roller 1 takes place when the separating agent metering device 30 is in the servicing position. The locking bars 16 are designed in such a way that they rest, in the pivoted-up state, on a stop provided in the region of the locking-bar pivot 28. Their side facing the separating agent metering tube 5 is then in an approximately horizontal position. In this position, the separating agent metering tube 5 can be placed on the locking bars 16, thus preventing damage to the hose 15 which has been slid over the separating agent inlet plug 9.

The variant in accordance with FIG. 5 has a separating agent inlet bushing 14. When the separating agent metering tube 5 is plugged into the flanges 31, the separating agent inlet plug 9 enters into the separating agent inlet bushing 14. Owing to the interaction between the separating agent inlet plug 9 and the separating agent inlet bushing 14, the separating agent metering tube 5 and thus the separating agent feed roller i are secured axially and radially against displacement. Additionally, the flanges 31 in the variant in accordance with FIG. 5 are of V-shaped design, the V-shape being of circular design at the contact region of its limbs such that the limbs engage partially around the separating agent metering tube 5 in a positive-locking manner. One of the limbs is designed as a spring limb 36. This spring limb 36 is deflected when the separating agent metering tube 5 is plugged in or taken out and, when the intended position has been reached, secures the separating agent metering tube 5 against dropping out. In this variant, the separating agent feed roller I can be removed completely from the separating agent metering device 30 in a simple manner and, in the removed state, is not connected to the hose.

In the embodiment in accordance with FIG. 6, the separating agent is supplied to the separating agent metering device 30 via the separating agent supply hose 15. The separating agent supply hose 15 is a constituent part of a separating agent supply device (not illustrated) which can be implemented by an electromechanical pump. The separating agent supply hose 15 is slid over a nipple 60 and is secured on the latter by means of a ring 61. The nipple 60 has a nipple bore 62 which opens out into a flange passage 63. The flange passage 63 runs at a right angle in the first flange 38. The nipple-side end of the flange passage 63 is directed at a right angle to the axis of the separating agent metering tube, whereas the end of the flange passage 63 on the separating agent metering tube side is flush with the axis of the separating agent metering tube.

Figure 7:
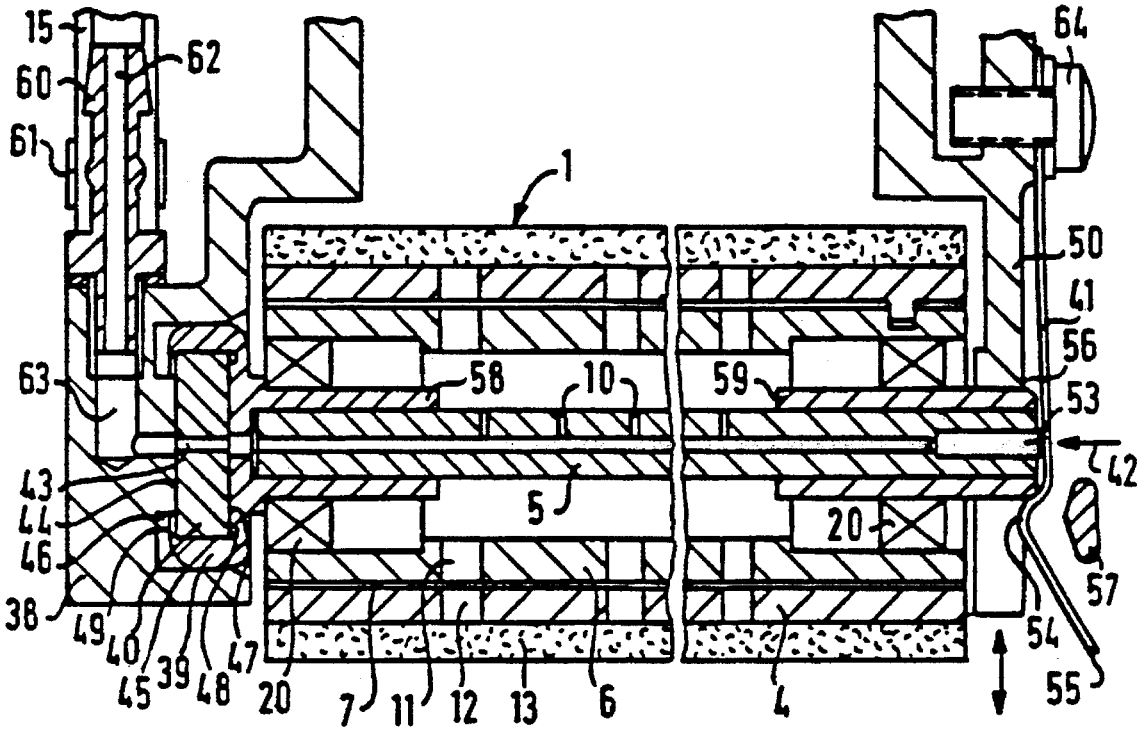
FIG. 7 shows a part of a separating agent metering device in axial section in accordance with FIG. 6.

FIG. 7 shows an axial section through the separating agent metering device 30. The separating agent feed roller i is arranged between the first flange 38 and the second flange 50. The separating agent feed roller I also comprises the separating agent metering tube 5 onto whose ends sleeves 58, 59 are pressed in each case. The sleeves 58, 59 serve on the one hand for the bearing of the separating agent metering tube 5 in the first and second flange 38, 50 of the separating agent metering device 30 and, on the other hand, for receiving heat-resistant deep groove ball bearings 20, by means of which the applicator roller 7 is mounted so as to be rotatable about the axis of the separating agent metering tube 5.

In order to supply the separating agent from the flange passage 63 to the inside of the separating agent metering tube 5, a liquid-tight axial clutch device is provided. The clutch device comprises a fitting bore 45 which is made in the first flange 38 and whose axis is flush with the axis of the separating agent metering tube 5 when it is in the installation position, and a clutch disk 39. The outer shape of the clutch disk 39 corresponds to a spherical segment with a radius equal to the radius of the fitting bore. The axis of symmetry of the clutch disk 39 disposed perpendicular to the flat surfaces of the spherical segment of equal area is flush with the axis of the separating agent metering tube.

The clutch disk 39 is produced integrally with the sleeve 58 pressed onto the separating agent metering tube 5. In another embodiment in which the sleeves 58, 59 could be dispensed with, the clutch disk 39 can also be produced integrally with the separating agent metering tube 5. Like the first flange 38, the clutch disk 39 has a passage. The passage of the clutch disk is directed axially and is flush with the axis of the separating agent metering tube.

Additionally, the clutch disk 39 has an axially directed, circular-cylindrical depression which starts from the flat surface of the spherical segment facing away from the separating agent metering tube 5. Placed in this depression is a sealing disk 40, the size of which corresponds approximately to the size of the depression.

In order to guarantee a high degree of tightness, the base of the depression in the clutch disk 39 is designed as a clutch-disk sealing surface 47. The clutch-disk sealing surface 47 is flat. The edge of the clutch-disk sealing surface 47 is set back from the clutch-disk sealing surface 47 in the form of a peripheral clutch-disk notch 48. This serves to provide a defined support of the sealing disk 40 at the edge of the depression. The sealing disk 40 is held in the depression of the clutch disk 39 in a positive-locking manner by means of a clutch-disk collar 49. The clutch-disk collar 49 is located at the outer edge of the depression and reduces the cross section of the depression at this point. The sealing disk 40 has a passage 43 whose axis is flush with the axis of the separating agent metering tube.

Along its axially directed walls, the fitting bore 45 has a peripheral groove 46. As a result of this groove 46 in the fitting bore, the base of the fitting bore has a ram-like elevation whose flat surface facing the sealing disc 40 forms a ram sealing surface 44. The ram sealing surface 44 is slightly smaller than the cross section of the depression, reduced by the clutch-disk collar 49, in the clutch disk 39. The ram sealing surface 44 rests with its entire surface on the sealing disk 40.

Figure 8:
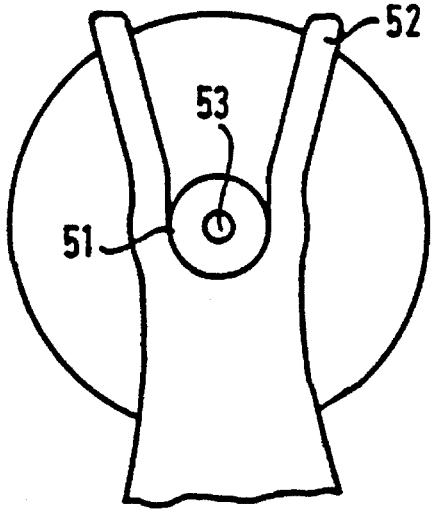
FIG. 8 shows a view of a second flange of the separating agent metering device in accordance with FIG. 6, said second flange receiving one end of the separating agent feed roller.

The second flange 50 of the separating agent metering device 30 is designed as a movable bearing. The second end of the separating agent metering tube 5 onto which the sleeve 59 is pressed can be placed radially in the movable bearing. The second flange 50 is designed accordingly, as shown in FIGS. 7 and 8. The second flange 50 has a semi-shell 51 which is open in the removal direction of the separating agent feed roller 1. This opening is designed as a semi-shell guide or funnel 52 in such a way that placing the separating agent metering tube 5 in the semi-shell 51 is facilitated.

At a point between the separating agent metering tube 5 and the axis of rotation 2 of the separating agent metering device 30, one end of a leaf spring 41 is attached by means of a clamping screw 64. The leaf spring 41 extends, starting from the clamping screw 64, beyond the end face of the separating agent metering tube 5. At this end face, the separating agent metering tube 5 has a hardened cylinder pin 53. The cylinder pin 53 projects beyond the surface of the end face and closes the separating agent metering tube 5 in such a way that no separating agent can emerge.

The leaf spring 41 has a prestress which causes a sealing power 42 axially on the separating agent metering tube 5 in the direction of the first flange 38 in the direction of the arrow. In this case, the leaf spring 41 rests on the hardened cylinder pin 53.

The special shaping of the leaf spring 41 serves as a locking means to prevent the separating agent metering tube 5 dropping radially out of the movable bearing of the second flange 50. In the region of the open side of the semi-shell of the second flange 50, the leaf spring 41 is bent in the direction of the first flange 38 in such a way that the leaf spring 41 rests on the sleeve 59. The sleeve 59 is chamfered in the contact region. The course of bending of the leaf spring 41 finally follows a round bending edge 54. This course of bending causes the free end of the leaf spring 41 to run obliquely outwards away from the two flanges 38, 50. This free end serves as a run-up slope which, when the separating agent feed roller 1 is inserted in the separating agent metering device 30, is pressed away from the second flange 50. An excessive deflection of the leaf spring 41 away from the second flange 50 is prevented by a spring-path limiter 57. When there is no separating agent feed roller 1 inserted in the separating agent metering device 30, the leaf spring 41 bears against a supporting point 56 on the second flange 50. This means that an operator can insert the separating agent feed roller 1 in the separating agent metering device 30 at any time without having to deflect the leaf spring 41, for example by hand. The deflection work is undertaken solely by the end-face end of the separating agent metering tube 5.

The round bending edge 54 of the leaf spring 41 means that the separating agent feed roller 1 cannot drop out of the semi-shell of the flange 50 when the separating agent metering device 30 is pivoted onto or away from the fuser roller 8. In the pivoted-on state of the separating agent metering device 30, the separating agent feed roller 1 is pressed radially into the semi-shell of the second flange by the forces acting between the separating agent metering device 30 and the fuser roller 8.

The flat sealing disk 40 is composed of a material which is resistant to silicone oil, is heat-resistant up to a maximum of 200° C. and has a specific Shore hardness, e.g. viton or silicone. The flat sealing disk 40 can be punched out of sheet material in a cost-effective manner or can be vulcanized. The Shore hardness and the thickness of the sealing disk 40 are parameters which are matched to one another so that absolute tightness is guaranteed under the least possible axial sealing force 42, in which case this must apply to the entire service life of a heat-and-pressure fusing apparatus, for example of 5 years. Furthermore, the flat sealing disk 40 must be so elastic that it always guarantees absolute tightness of the clutch device in the case of tolerance with extremely non-parallel sealing surfaces 44, 47. The size of the sealing-disk bore 43 is selected such that it acts as a throttle against the escape of the contents of the separating agent metering tube if the clutch device becomes separated.

To remove the separating agent feed roller 1, an operator picks it up, without the risk of burning, on the thermally insulating felt casing, serving as the layer of material 13 which is permeable to the separating agent, near to the second flange 50 and lifts the separating agent feed roller 1 out jerkily obliquely upwards counter to the friction force which acts between the end-face end of the separating agent metering tube 5 and the leaf spring 41. The applicator sleeve 4 can now be removed from the station-bound carrier tube 6 and be replaced by a new applicator sleeve 4. To install the replaced separating agent feed roller 1, the operator plugs the clutch disk 39 into the fitting bore 45 of the first flange 38. The other end of the separating agent metering tube 5 is placed in the semi-shell funnel 52 and pressed against the run-up slope 55 of the leaf spring 41. The leaf spring 41 springs outwards and is locked automatically when it springs back by means of the round bending edge 54. The separating agent feed roller 1 is thus anchored in a liquid-tight manner in the separating agent metering device 30.

It should be understood that various changes and modifications to the presently preferred embodiments will be apparent to those skilled in the art. Such changes and modifications can be made without departing from the spirit and scope of the present invention and without diminishing its attendant advantages. Therefore, it is intended that such changes and modifications be covered by the appended claims.

What is claimed is:

1. A separating agent metering device for supplying separating agent to a surface of a fuser roller of a transfer-printing apparatus, the metering device comprising:

a) a separating agent metering tube with at least one separating agent metering opening arranged along its longitudinal extent;

b) a carrier tube rotatably mounted on the separating agent metering tube with plurality of circumferentially positioned passage openings for the separating agent;

c) a replaceable applicator roller slidable axially over the carrier tube the applicator roller having:

an applicator sleeve which receives the carrier tube and has a plurality of passage openings for the separating agent which are at least partially congruent with the passage openings in the carrier tube; and a layer of material which is permeable to the separating agent and is attached to the outer circumference of the applicator sleeve to apply the separating agent.

2. The separating agent metering device as claimed in claim 1, further comprising an applicator sleeve which has semi-shells which can be fitted together.

3. The separating agent metering device as claimed in claim 2, in which the semi-shells are made of heat-resistant thermoplastic.

4. The separating agent metering device as claimed in claim 1, further comprising positive-locking carrier means provided between the carrier tube and the applicator roller.

5. The separating agent metering device as claimed in claim 1, in which at least one radially extending notch is provided both on the outside diameter of the carrier tube and on the inside diameter of the applicator roller, each notch being disposed generally in the region of a respective end face.

6. The separating agent metering device as claimed in claim 1, further comprising a pivoting apparatus which pivots the separating agent metering device about an axis of rotation parallel to an axis of the fuser roller into various selected operating positions.

7. The separating agent metering device as claimed in claim 6, in which the separating agent feed roller can be removed from the separating agent metering device when the pivoting apparatus is in a servicing position.

8. The separating agent metering device as claimed in claim 1, further comprising a hydraulic clutch which couples the separating agent metering tube to a separating agent supply device.

9. The separating agent metering device as claimed in claim 8, in which:

a) a separating agent inlet plug protrudes radially from the separating agent metering tube; and b) a separating agent inlet bushing is arranged on the separating agent metering device to receive the separating agent inlet plug enters into the separating agent inlet bush when the separating agent feed roller is inserted into the metering device.

10. The separating agent metering device as claimed in claim 8, in which:

a) the ends of the separating agent metering tube are respectively mounted in a first and a second flange;

b) the first flange has a fitting bore whose axis is flush with the axis of the separating agent metering tube when it is in the installation position, and whose end-face base has at least one flange passage connected to the separating agent supply device; and c) the end of the separating agent metering tube mounted in the first flange is a clutch disk;

wherein the clutch disk has an outer surface shaped as a spherical segment with a radius equal to the radius of the fitting bore, and having an axis of symmetry disposed perpendicular to the flat part of the surface of the spherical segment is flush with the axis of the separating agent metering tube, and wherein the clutch disk has a passage directed axially, leading to the separating agent metering tube and is flush with an axially aligned part of the flange passage.

11. The separating agent metering device as claimed in claim 10, further comprising a sealing disk positioned between the clutch disk and the base of the fitting bore, the sealing disk having a passage which is flush with the axially aligned part of the flange passage (63).

12. The separating agent metering device as claimed in claim 10, in which the second flange is a movable bearing, in which the separating agent metering tube is positionable in a radial direction, the movable bearing including:

at least one locking element which secures the separating agent metering tube radially; and at least one element which presses the separating agent metering tube axially in the direction of the first flange.

13. The separating agent metering device as claimed in claim 10, in which at least one leaf spring is attached on one side of the second flange, the leaf spring engaging in a positive-locking manner around the corresponding end of the separating agent metering tube to lock it against dropping out and presses the separating agent metering tube axially in the direction of the first flange.

14. The separating agent metering device as claimed in claim 10, in which:

a peripheral fitting-bore groove (46) is disposed in the base of the fitting bore (45) along its axially directed walls so that the base has a ram-like elevation, into whose surface the axially directed part of the flange passage opens out, the clutch disk has an axially directed depression in which the sealing means is disposed, and the cross section of the ram-like elevation is smaller than the cross section of the depression in the clutch disk.

15. The separating agent metering device as claimed in claim 14, in which the sealing disk is held in the depression in a positive-locking manner by a collar which reduces the cross section of the depression.

16. The separating agent metering device as claimed in claim 1, further comprising spring rings which are slidable over the separating agent metering tube to close selected individual metering tube openings.

17. The separating agent metering device as claimed in claim 16, in which the spring rings are split so that the metering openings are closeable by turning the spring rings radially.

* * * * *